US006404452B1

(12) United States Patent
Spano

(10) Patent No.: US 6,404,452 B1
(45) Date of Patent: Jun. 11, 2002

(54) AUXILIARY CONTROL DEVICE FOR MANAGING PRINTING IN A THERMAL PRINTER

(75) Inventor: Steven Spano, Ithaca, NY (US)

(73) Assignee: Axiohm Transaction Solutions, Inc., Ithaca, NY (US)

( * ) Notice: Subject to any disclaimer, the term of this patent is extended or adjusted under 35 U.S.C. 154(b) by 0 days.

(21) Appl. No.: 09/632,105

(22) Filed: Aug. 3, 2000

(51) Int. Cl.[7] ..... B41J 2/36
(52) U.S. Cl. ..... 347/195
(58) Field of Search ..... 347/195; 400/120.15

(56) References Cited

U.S. PATENT DOCUMENTS

| | | | | |
|---|---|---|---|---|
| 4,452,136 A | | 6/1984 | Boynton et al. | |
| 5,133,611 A | * | 7/1992 | Nakajima | 400/120.16 |
| 5,559,547 A | | 9/1996 | Hagar | |
| 6,008,831 A | | 12/1999 | Nakanishi et al. | |

* cited by examiner

*Primary Examiner*—John Barlow
*Assistant Examiner*—R. Feggins
(74) *Attorney, Agent, or Firm*—George R. McGuire; Hancock & Estabrook, LLP

(57) ABSTRACT

The present invention provides a dot history compensation system for varying the drive current to the points of a thermal print head in response to the printing history of the points. One or two previous print lines may be examined. In addition, the history of points adjacent to a selected point may be used to compute a head drive signal. The inventive system is implemented in an auxiliary control device within a thermal printer. In addition, an end point compensation system is provided to ensure that end points of a thermal print head receive equivalent amounts of energy to central points, even when a large number of points may be simultaneously fired. The inventive system is adapted for operation with both single color and multiple color thermal printers. The auxiliary control device also manages paper movement functions, thus freeing the main microprocessor for communications and other duties within the printer. Specifically, the auxiliary control device provides a dot history system, both row-to-row and adjacent dots, for use in either a single color or multiple color thermal printer.

10 Claims, 7 Drawing Sheets

GROUP #1

| | | |
|---|---|---|
| | 0 | |
| X | 0 | X |
| | 1 | |

GROUP #2

| | | |
|---|---|---|
| | 1 | |
| 0 | 0 | 0 |
| | 1 | |

| | | |
|---|---|---|
| | 1 | |
| 1 | 0 | 0 |
| | 1 | |

| | | |
|---|---|---|
| | 1 | |
| 0 | 0 | 1 |
| | 1 | |

GROUP #3

| | | |
|---|---|---|
| | 1 | |
| 1 | 0 | 1 |
| | 1 | |

GROUP #4

| | | |
|---|---|---|
| | 0 | |
| X | 1 | X |
| | 1 | |

GROUP #5

| | | |
|---|---|---|
| | 1 | |
| X | 1 | X |
| | 1 | |

FIG. 4a

GROUP #1

| |
|---|
| 0 |
| 0 |
| 1 |

GROUP #2

| |
|---|
| 1 |
| 0 |
| 1 |

GROUP #3

| |
|---|
| 0 |
| 1 |
| 1 |

GROUP #4

| |
|---|
| 1 |
| 1 |
| 1 |

FIG. 4b

AUXILIARY CONTROL DEVICE FOR MANAGING PRINTING IN A THERMAL PRINTER

FIELD OF THE INVENTION

The present invention relates to the field of controllers for printers and, more particularly, to the use of an auxiliary control device within a color thermal printer for managing printing and/or paper handling functions.

BACKGROUND OF THE INVENTION

Printers continue to become more and more sophisticated, in response to commerce demanding increasingly more functionality from printers. Adding to the complications created by this situation, printing speeds have also become higher. Even though microprocessors suitable for performing control functions within printers have increased in sophistication, the demands upon the microprocessors have outpaced their development. The need for optimum communication between a printer and its host has placed additional demands upon the printer's built-in processor.

Thermal printers introduce yet another level of complication: the characteristics of the thermal print head change from character to character. This means that a character printed with a cold print head may appear on the media differently than do characters printed after the head is warm. In some applications, the quality of the print is critical. In other applications, good print quality, while not critical, may cause a customer to select one printer over another because of subjective differences in print quality. The added complexity of color (i.e., two or more color) thermal printers demands even more control of printing parameters.

Sophistication is required to manage the thermal hysteresis in the print heads. One such management tool known to those skilled in the thermal printer arts is called "dot history". In a dot history system, the instant thermal status of the thermal print head is estimated based upon the history of the dots previously printed. If a particular point on a thermal print head has just completed a task with a high duty cycle, that point will, probably, be hotter that a print head point which has been idle for a period of time. By adjusting the drive energy to the print head points based upon their estimated thermal status, print quality is typically improved and print head overheating is avoided.

One solution to alleviate the print head control problem is to split the processing duties between two microprocessors, both within the printer itself. One logical distribution of functions is to use a first microprocessor for communications management and a second microprocessor for printing management. The second or auxiliary processor is then free to devote its attention to the printing process itself.

U.S. Pat. No. 4,452,136 for PRINTER SUBSYSTEM WITH DUAL COOPERATING MICROPROCESSORS, issued Jun. 5, 1984 to William W. Boynton, et al., teaches the use of one internal microprocessor to manage data communications with a host and a second, cooperating microprocessor to manage the printing and paper handling functions in a high-speed, wire matrix printer. The effect of self-generated heat on a wire matrix print head is generally much less pronounced than in a thermal print head. Consequently, BOYNTON, et al. direct the activities of their auxiliary processor to managing print head position and moving paper, not to compensating for thermal effects in a thermal print head. BOYNTON, et al. incorporate no teaching of a dot history or similar adjustment of the print data; nor is the firing energy adjusted to the wires of the wire matrix print head.

U.S. Pat. No. 5,559,547 for THERMAL PRINTER, issued to Gamal Hagar teaches a system for improving the utilization of a microprocessor. HAGAR discloses an arrangement of buffer storage to improve the printing efficiency of a thermal printer. However, there is no teaching of an auxiliary microprocessor or of a dot history or similar print quality control.

U.S. Pat. No. 6,008,831 for APPARATUS FOR CONTROLLING DRIVING OF THERMAL PRINTHEAD, issued to Masatoshi Nakanishi, et al. teach a rudimentary dot history arrangement for driving a thermal print head. Nakanishi et al. provide a plurality of shift registers to store data corresponding to successive rows of print data. Driving (printing) energy is varied to each point of the thermal print head dependent upon whether the previous data was a "1" or a "0" (i.e., whether the point was just fired or was idle). There is no teaching of an auxiliary microprocessor or of the application of a dot history print energy control system to a color thermal printer.

It is, therefore, an object of the invention to provide an auxiliary control device to manage print head and paper movement functions in a thermal printer.

It is an additional object of the invention to provide an auxiliary control device in a thermal printer to provide a high-speed dot history control system for single-color printing.

It is another object of the invention to provide an auxiliary control device in a thermal printer to provide a dot history control system for color printing.

It is a further object of the invention to provide an auxiliary control device in a thermal printer compatible with dot print heads and operable with any number of loading inputs.

It is yet another object of the invention to provide an auxiliary control device in a thermal printer which provides at least two previous levels of dot history for single-color printing.

It is a still further object of the invention to provide an auxiliary control device in a thermal printer to provide at least one previous level of adjacent left and right dot history for single-color printing.

It is yet another object of the invention to provide an auxiliary control device in a thermal printer which provides at least one previous level of dot history for color printing.

It is an additional object of the invention to provide an auxiliary control device in a thermal printer which provides at least one previous level of energy level setting for two-color printing.

It is a further object of the invention to provide an auxiliary control device in a thermal printer for up to eight thermal head reloading cycles.

It is a still further object of the invention to provide an auxiliary control device in a thermal printer which provides both 64-point stepper motor acceleration ramp tables and stepper motor current drive tables.

It is another object of the invention to provide an auxiliary control device in a thermal printer which interfaces with standard, external stepper motors. Interfaces provided are for full, half, and micro stopping.

It is an additional object of the invention to provide an auxiliary control device in a thermal printer which provides programmable end dot compensation.

It is a further object of the invention to provide an auxiliary control device in a thermal printer which provides user programmable, on-chip SRAM.

SUMMARY OF THE INVENTION

In accordance with the present invention there is provided an auxiliary control device for use in a thermal printer to manage printing and paper movement functions. This frees a main microprocessor for communications and other duties within the printer. Specifically, the auxiliary control device provides a dot history system, both row-to-row and adjacent dots, for use in either a single or multiple color (i.e., two or more color) thermal printer.

BRIEF DESCRIPTION OF THE DRAWINGS

A complete understanding of the present invention may be obtained by reference to the accompanying drawings, when considered in conjunction with the subsequent detailed description, in which:

FIGS. 4*a* and 4*b* depict possible dot pattern combination groups for single color and multiple color printing, respectively;

DETAILED DESCRIPTION OF THE PREFERRED EMBODIMENT

The present invention provides an auxiliary control device for use in a thermal printer to manage printing and paper movement functions. This frees a main microprocessor for communications and other duties within the printer. Specifically, the auxiliary microprocessor provides a dot history system, both row-to-row and adjacent dots, for use in either a single or multiple color thermal printer. Color thermal printing would require twice the resources from a microprocessor, thus creating a speed limit. The co-processor does not suffer from any speed limits due to its 100% hardware scheme. The auxiliary microprocessor provides for the direct control of external stepper motors utilizing a 64-point table for both acceleration and control.

Figure 1:
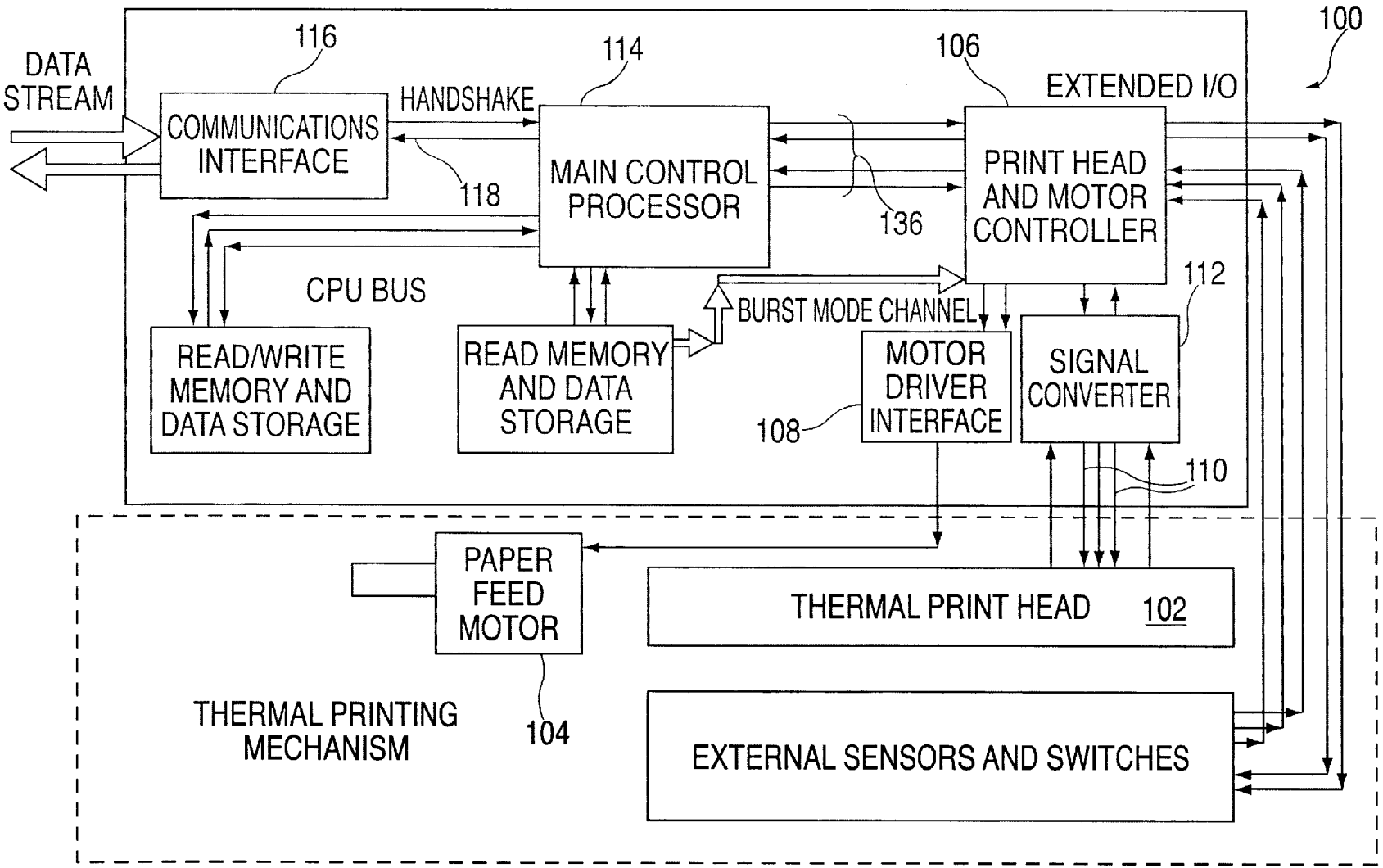
FIG. 1 is a schematic block diagram of a typical thermal printer using an auxiliary microprocessor.

Referring first to FIG. 1, there is shown a schematic block diagram of a typical thermal printer, generally at reference number 100. A thermal print head 102 containing multiple thermal points (not shown) is provided for interacting with direct thermal paper (not shown). While direct thermal writing has been chosen for purposes of disclosure, it will be obvious to those skilled in the printer design arts that thermal transfer printing, incorporating an interposed thermal ribbon between the print head and plain paper, could easily be used with the inventive system.

The paper is typically moved, relative to a print head 102, by a paper drive system, powered by a stepper motor 104. Stepper motor 104 receives its control inputs from a print head motor controller 106, which is an auxiliary microprocessor, in combination with an appropriate stepper motor driver interface 108. Controller 106 may include memory, shift registers, and other components needed to accomplish the functions of the inventive system as described in detail hereinbelow. In addition to providing control signals for stepper motors 104 and interface 108, controller 106 also manages the print signals sent to print head 102 on print signal bus 110 through signal converter 112. Controller 106 performs the inventive dot history processing which alters the drive signals to print head 102, dependent upon the printing history of both a particular print head point (not shown) and the history of adjacent print head points (not shown). The dot history processing is described in detail hereinbelow.

A main control processor 114 is connected to controller 106 by bi-directional data bus 136. A communications interface 116 is provided to adapt printer 100 to communications media 124. Communications media 124 represents any interconnection strategy, known to those skilled in the art, by which printer 100 may be connected, either directly or indirectly, to a host (e.g., a computer, controller, etc.). The interconnection topology forms no part of the instant invention and any of a wide variety of topologies known to those skilled in the art may be used. Communications interface 116 is connected to main microprocessor 114 by bi-directional data bus 118.

Figure 2:
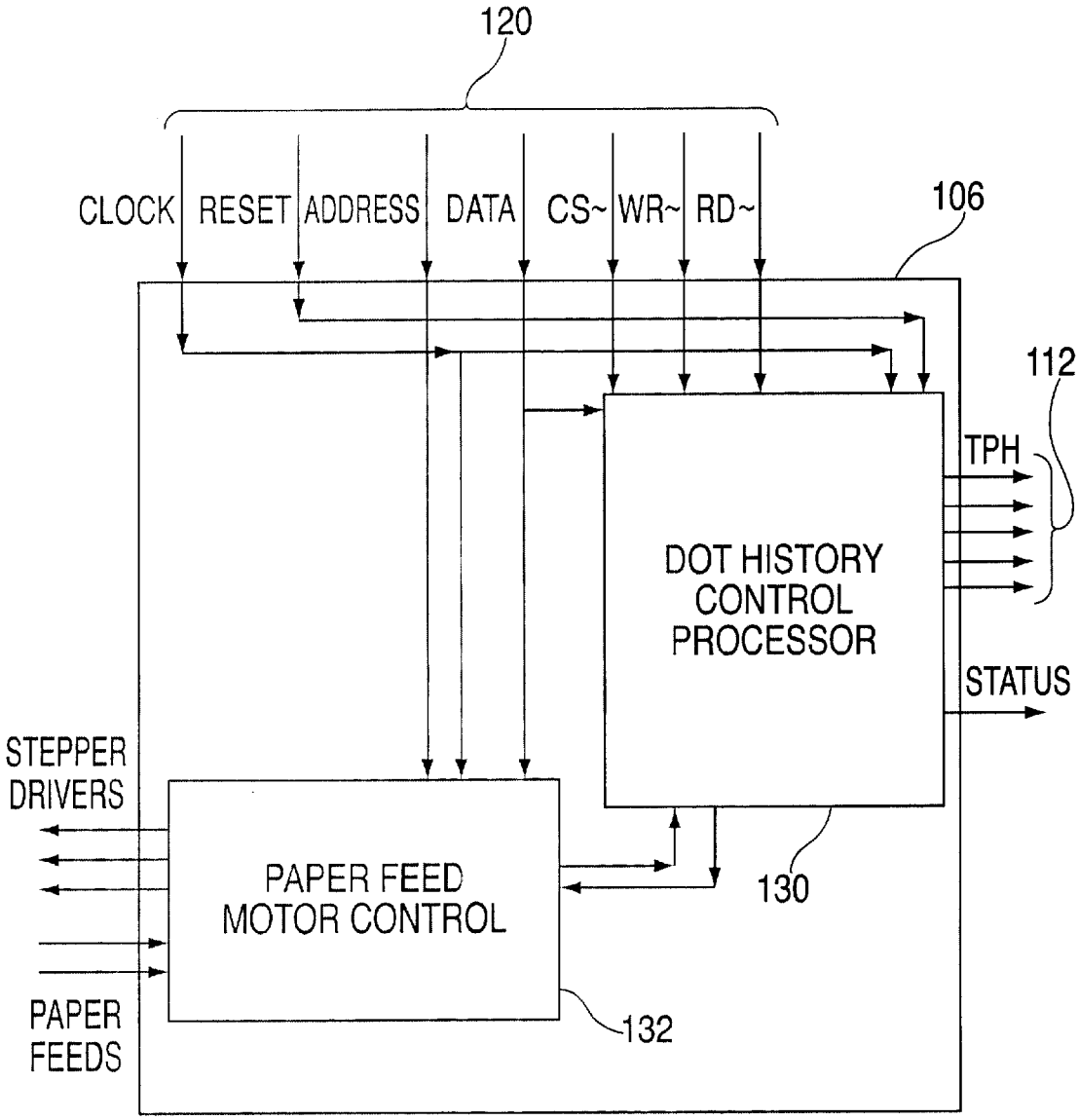
FIG. 2 is a schematic block diagram of the auxiliary control device (microprocessor) in accordance with the present invention.

Referring now also to FIG. 2, there is shown a detailed block diagram of print head and motor control processor 106. Processor 106 embodies two subsystems: a dot history control processor (DHCP) 130 and a paper feed motor control 132. The functions of paper feed motor control subsystem 132, generally well known to those skilled in the printer control systems art, are implemented in the present control processor 114.

Processor 106 is designed to interface with a standard 16-bit external microprocessor (e.g., main control processor 114). Processor 106 provides standard CS, RD, WR, address and data lines, all well known to those skilled in the microprocessor art. Communication between main control processor 114 and the processor 106 is accomplished via a 16-bit data bus 136 (FIG. 1), which is fully read and/or write compliant. Main control processor 114 can read/write to all locations of the memory map (not shown).

The main control processor 114 sends dot-row data to the processor 106 over data bus 136. A total of 40 word writes is required for a single-color print process. A total of 80 or 120 word writes is required for a color print process. A handshake allows internal pipelining of the dot-row data. The dot history control processor 130 can be loaded with the next dot-row bits at the same time that it is printing/calculating/reloading the current dot-row.

Dot history control is accomplished with combinational logic. The result of the combinational logic is based on the dot-history patterns shown in FIGS. 4*a* and 4*b* for single-color and two-color printing, respectively. The combinational logic yields five specific cases of dot-history patterns. A user-programmable SRAM (not shown) is provided to further reduce the specific cases to a number less than five. This SRAM essentially stores the bit masks that are used to combine the specific cases into common groups. This reduction is used to facilitate anywhere from one to five head reloadings for history control.

The head reloadings have a large 64×8 SRAM space associated with them, containing reload timing data. This SRAM allows a user to download parameters to specify the timing of each reload. For example, if two reloads are being used, the user may specify a strobe time of 60% of nominal for the first reload and 40% of nominal for the second reload. These timing values are also a function of speed and are therefore related to the stepper ramp tables.

The total SRAM space is composed of four groups of 16×8 SRAM. Each SRAM block corresponds to 16 points in the ramp table. The lower 8×8 region of memory corresponds to the next eight ramp points. Each 16×8 SRAM block provides a space for the reload timings if the user configures the processor for dot history control. Therefore, depending on the print speed, it is possible to provide different reload timings. This is beneficial for constant energy control with varying printing speeds.

Processor 106 is connected to an external stepper motor driver circuit 108 (FIG. 1). Processor 106 controls the ramping/steady-state operation of the external stepper motor during thermal printing. Processor 106 provides 64, 16-bit SRAM locations for stepper motor timing values. This SRAM behaves in accordance with the acceleration table. A register is provided to set the print speed rate, which can be adjusted at any time during the thermal printing process. A change in the print speed rate causes a corresponding ramp-up or ramp-down depending on the values in the acceleration table.

Processor 106 is capable of providing all logic signals to a thermal print head. This processor 106 is also capable of driving the paper feed stepper motor 104 (FIG. 1) directly. In order for the dot history control processor 106 to operate, an array of SRAM and flip-flop registers must be initialized prior to sending any dot-row data dot history control processor 106.

Figure 3A:
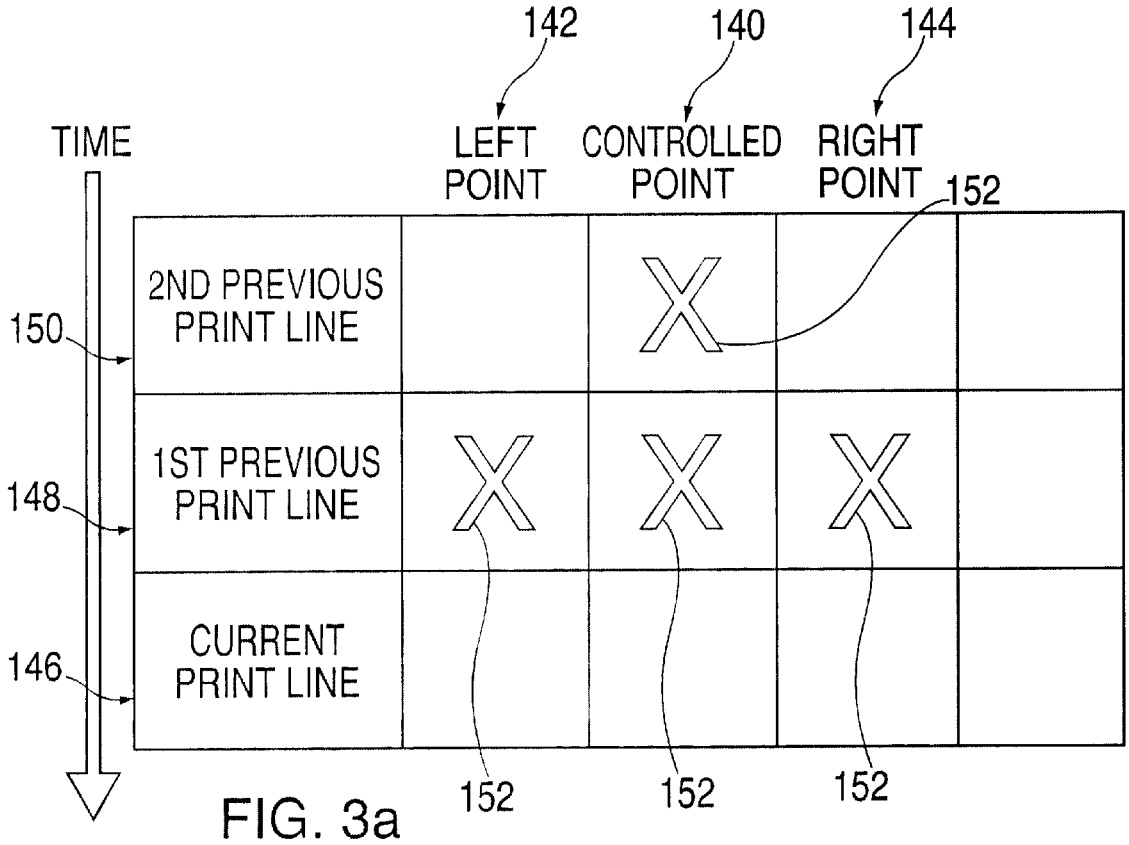
FIGS. 3*a* and 3*b* are tabular representations of the dot history data considered for both single color and multiple color printing, respectively.

The dot history control processor (DHCP) 130 is novel. Its implementation on control processor 106 allows for a much more sophisticated implementation than that shown in the prior art. First, when in single-color mode, two previous lines of dot history are considered in calculating a suitable energization level for a particular point of print head 102. In addition, when in single-color mode, the history of adjacent thermal points is also included in the calculation of the print head energy level. For single-color printing, this is shown schematically in FIG. 3*a*. An arbitrary point 140 in thermal print head 102 is surrounded by points 142, 144 to the immediate right and left of point 140, respectively. The current print line 146, a first previous print line 148, and a second previous print line 150 are also shown. "Xs" 152 are placed at the appropriate intersections indicating the conditions for which data is chosen for computing a drive level for thermal print heads point 140. In summary, for single-color printing, two previous lines of data for the particular point 140, as well as both right and left data from a first previous print line, are use to calculate the drive energy for the point 140.

There are 16 possible combinations of on and off bits in positions 152. Each of these 16 combinations is placed into one of the five discrete groups shown in FIG. 4*a*. These groups define bit patterns for the dot history control processor 130 (FIG. 2). A region of memory (not shown) is used to store masks (not shown) that indicate which of these defined groups are on or off at each reload (i.e., during movement of data and control parameters to print head 102).

In the dot history implementation of the instant invention, two modes of operation are possible in the single-color print mode. First, the entire two-level history along with adjacent point histories may be used. This is called "Equation 1" operation. A second operating mode (i.e., "equation two") may be user-selected whereby the adjacent point history data is ignored.

Figure 3B:
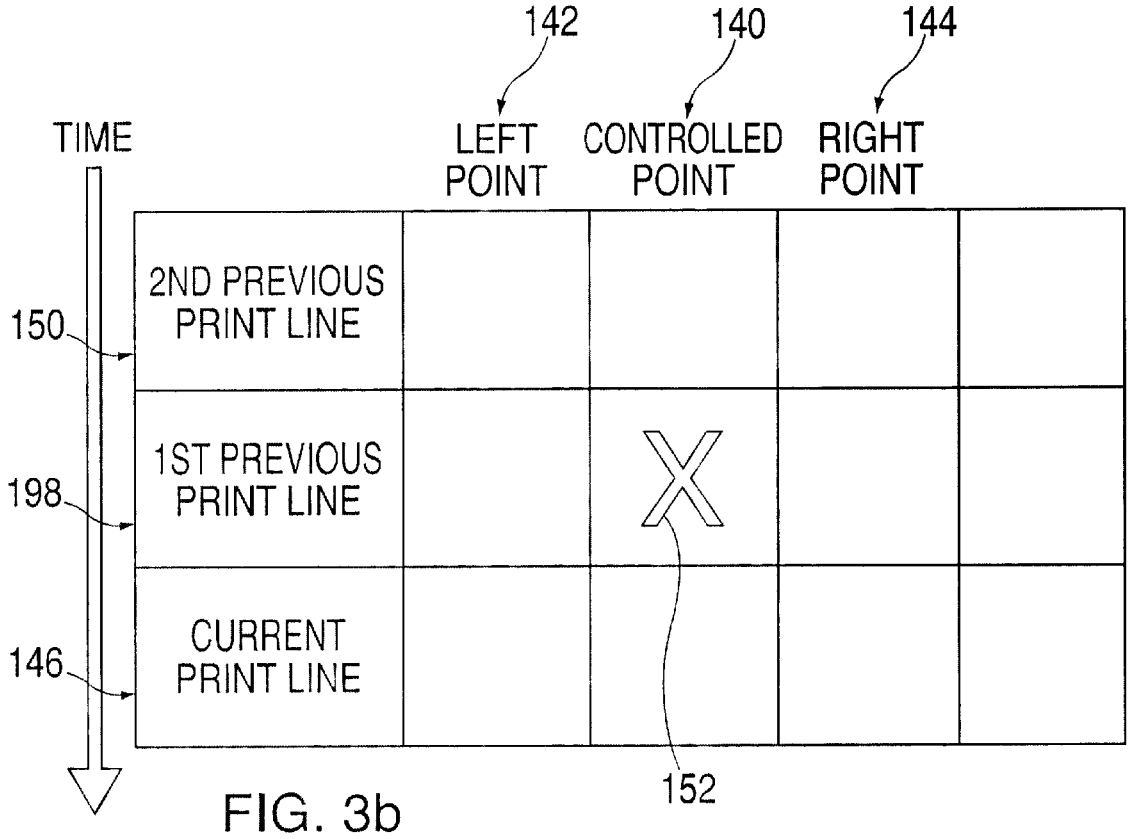

Referring now to FIG. 3*b*, there is shown a similar representation for color printing. In this case, only a single level of previous history for the point 140 is considered. Consequently, only 16 possible combinations may be formed. Each of these combinations is placed in one of four discrete groups as shown in FIG. 4*b*.

Figure 5:
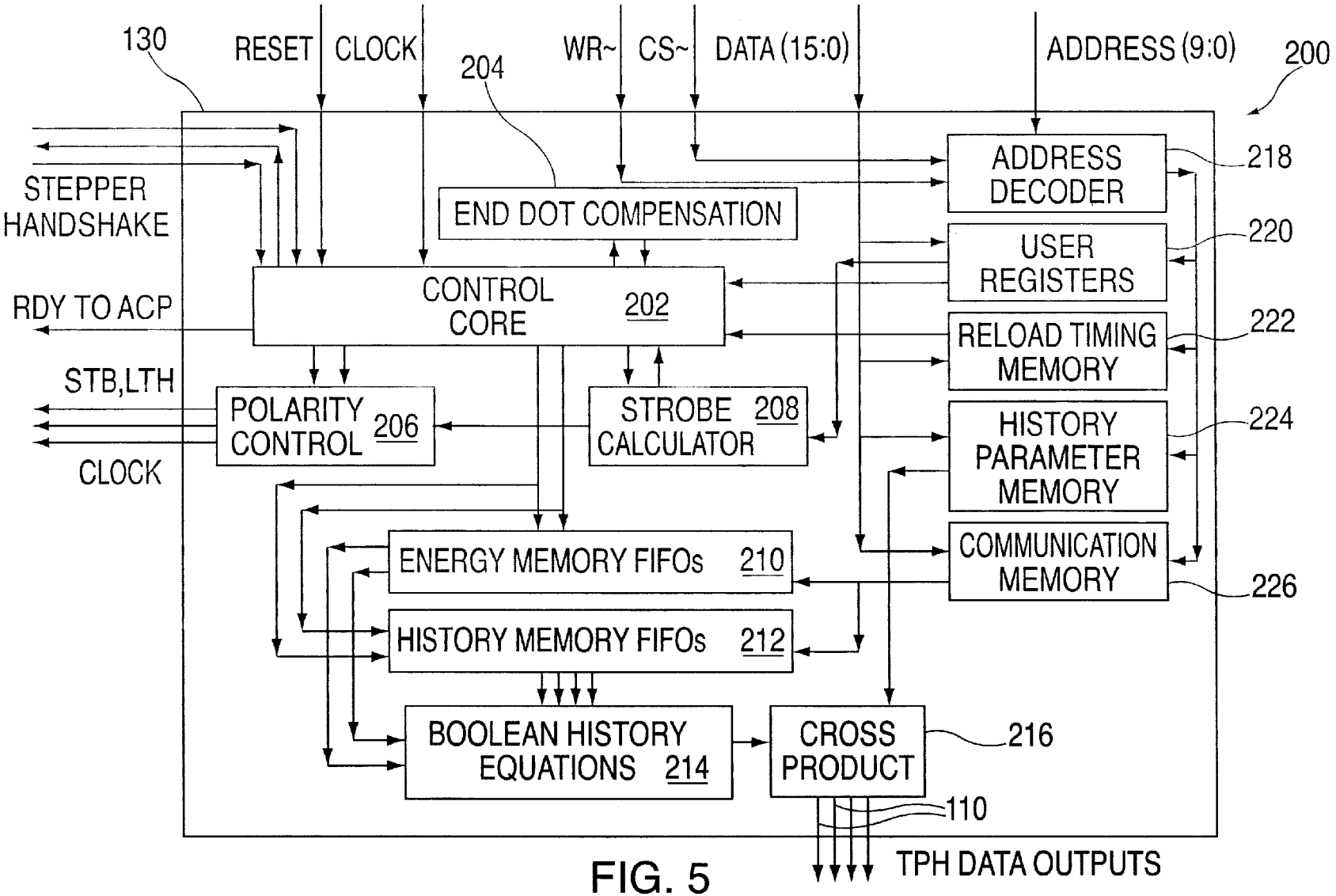
FIG. 5 is a detailed block diagram of the dot history processor.

Referring now to FIG. 5, there is shown a detailed, schematic block diagram of DCHP 130 (FIG. 2). The architecture disclosed therein has been found suitable for implementing the dot history system and other features of the present invention. It should be obvious to those skilled in the art that many other configurations to meet a particular operating environment or circumstance could also be chosen.

A control core 202 is connected to an end dot compensation block, 204. Control core 202 is also connected to a polarity control block 206, and a strobe calculator block 208, energy memory FIFO buffers and history memory FIFO buffers 212. Energy memory FIFO buffers 210 and history memory FIFO buffers 212 are both connected to a Boolean history equation block 214, which is, in turn, connected to cross product block 216. Thermal print head bus 110 is connected to cross product block 110. other blocks including address decoder 218, user registers 220, reload timing memory 222, history parameter memory 224 and communication memory 226 are all interconnected to control core 202 and various other blocks of the auxiliary processor 130 as shown.

Figure 6A:
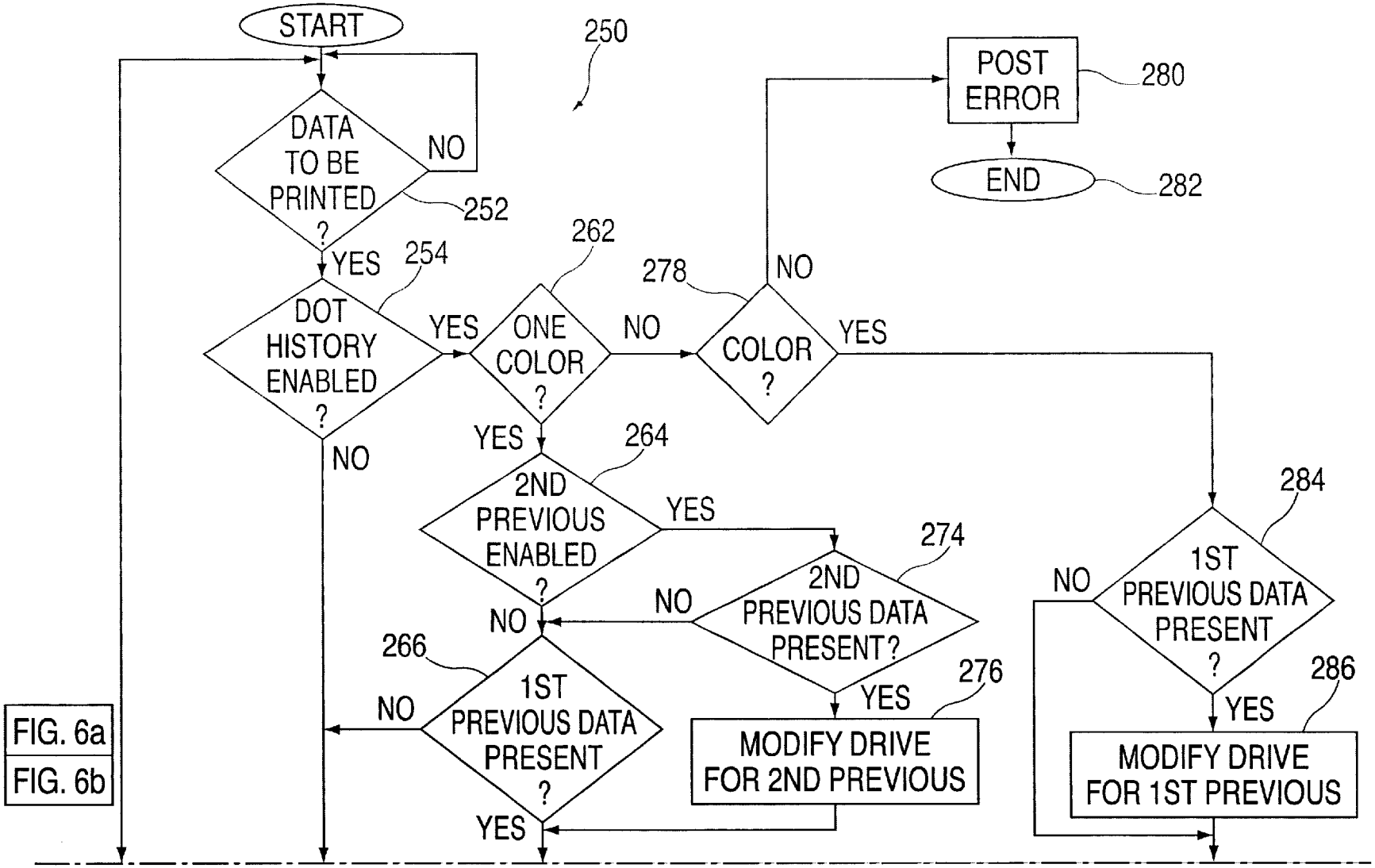
FIGS. 6*a* and 6*b*, taken together (see interconnection diagram, FIG. 6), depict the steps of the dot history processor.
Figure 6B:
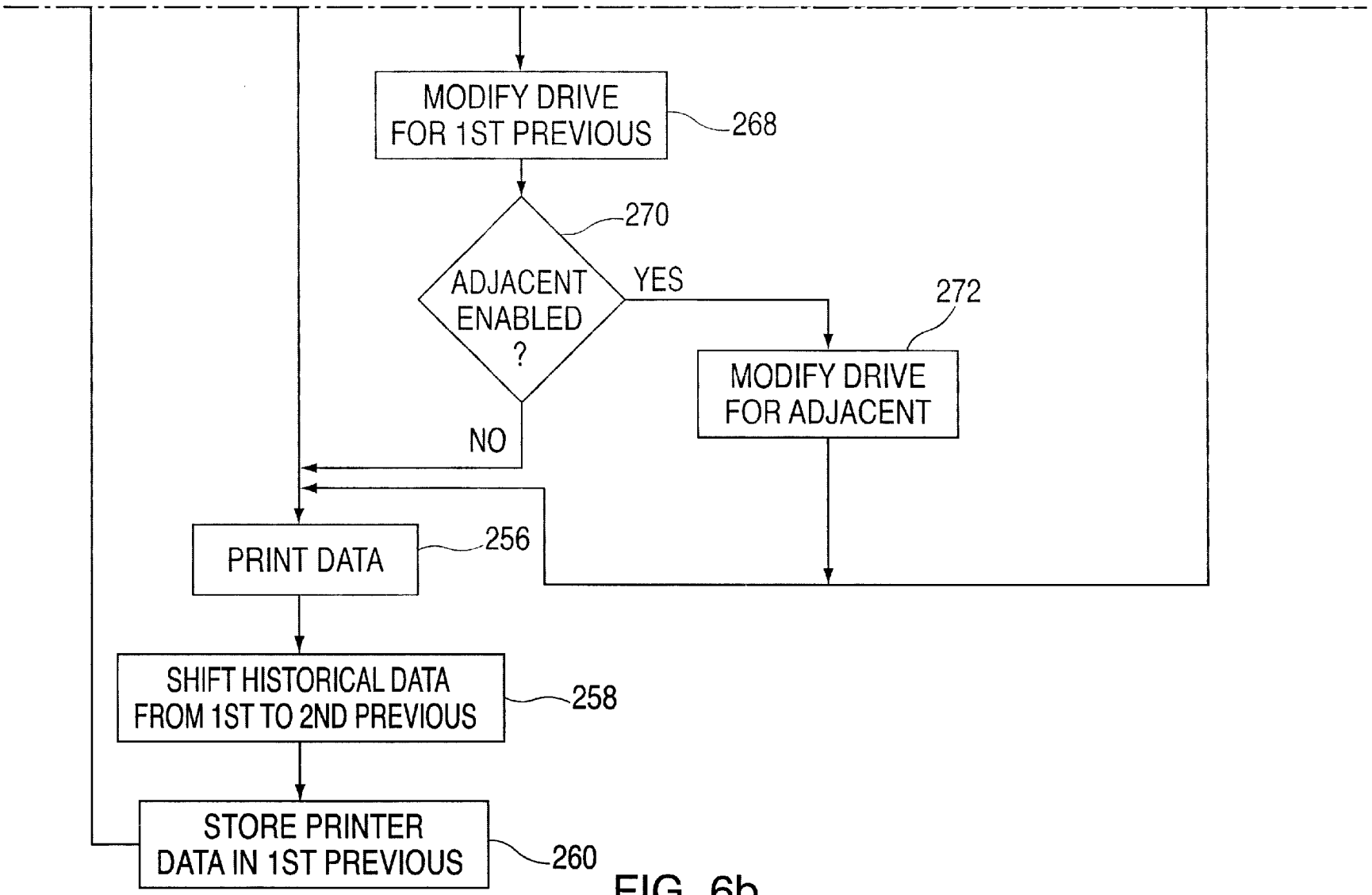

Referring now to FIGS. 6*a* and 6*b*, there is shown a simplified flowchart 250 illustrating the steps of the inventive dot history process. First, a check is made to determine if any data is to be printed, step 252. If data is to be printed, a check is made to see if the dot history feature has been activated, step 254. If dot history is not active, the data is printed, step 256. Any data in the first previous buffer is shifted to the second previous buffer, step 258. The just-printed data is stored in the first previous history buffer, step 260, and control is returned to block 252 to await further data to be printed.

If, however, dot history is active, step 254, the print mode is checked, step 262. If single-color printing is enabled, the status of the second previous line history option is checked, step 264. If second previous line history is not active, a check is made to see if any historical data for the first previous print line exists, step 266. If a first previous line historical data is available, a dot history computation is performed (i.e., the drive signals associated with the data are modified) based on the first previous line data, step 268. The adjacent dot feature is checked, step 270.

If the adjacent dot feature is inactive, the modified data is printed, step 256. If, however, the adjacent dot feature is active, step 270, the drive signals are further modified in accordance with adjacent dot history, step 272, and the data is printed, step 256.

Returning now to step 264, if the second previous line feature is enabled, the presence of second previous line historical data is checked, step 274. If no second previous line historical data is present, control is returned to block 266 and processing continues as already described. If, however, second previous line historical data is present, step 274, the print drive signals are modified in accordance with this data, step 276 and control is returned to block 266.

Referring again to block 262, if single-color printing is not selected, a check is made to determine if color printing is selected, step 278. If color printing is not selected, an error condition is posted, step 280, and processing is terminated, step 282. If color printing is selected, step 278, a check is made for the presence of first previous line historical data, step 284. If first previous line historical data is not present, the data is printed, step 256. If, however, first previous line historical data is present, step 284, the drive signals are modified in accordance with this data, step 186, and the data is printed, step 256.

In addition to providing drive energy control to thermal print head 102, the inventive system provides end dot compensation. This feature is used to specify an extension factor for the nominal strobe pulse width which provides compensation based on the number of dots being fired on each dot row. If a large number of dots are fired at the same time, more current is required by the print head 102. This causes voltage drop through high side FET & cables. This voltage drop requires that the strobe period be elongated to ensure a constant optical density. A register is used to accomplish this. The register is split into two segments: the grouping factor (bits 7–4) and the extension factor (bits 3–0). Extension factor is a number between 0 and 15, representing an increment to the nominal strobe width register. The grouping factor is used to specify how many dots must be fired before the extension factor will be applied.

For example, grouping factor may equal 1 and extension factor may equal 15. This means that for every two dots being fired, fifteen counts will be added to the nominal strobe width. Therefore, if 640 dots are being fired, the strobe will extend (640/2) * 15=4800 system clock cycles. The grouping factor and extension factors allow fractional multiplication of the total number of dots fired (on any dot row). The result is a number that is added to the nominal strobe width. This extension allows the strobe width to increase proportional to the number of dots fired on any dot row.

At reset, the grouping factor=0 and extension factor=0. This state means that no end dot compensation will be applied. Table 1 shows the relationship between the grouping factor and the number of dots being fired.

TABLE 1

| Grouping Factor | Result |
|---|---|
| 0 | No End Dot Compensation |
| 1 | Increment by Extension Factor for every 2 dots on |
| 2 | Increment by Extension Factor for every 3 dots on |
| 3 | Increment by Extension Factor for every 4 dots on |
| 4 | Increment by Extension Factor for every 5 dots on |
| 5 | Increment by Extension Factor for every 6 dots on |
| 6 | Increment by Extension Factor for every 7 dots on |
| 7 | Increment by Extension Factor for every 8 dots on |

The following equation shows the relationship between this register and the strobe width applied to the print head.

$$AppliedStrobe = NominalStrobeWidth + \frac{\#DotsON}{GroupingFactor+1} * ExtensionFactor$$

If this end-dot compensation is not sufficient, the host microprocessor 114 can compute its own version of end-dot compensation and use that value for the nominal strobe time.

Since other modifications and changes varied to fit particular operating conditions and environments or designs will be apparent to those skilled in the art, the invention is not considered limited to the examples chosen for purposes of disclosure, and covers changes and modifications which do not constitute departures from the true scope of this invention.

Having thus described the invention, what is desired to be protected by letters patents is presented in the subsequently appended claims.

What is claimed is:

1. A processor for controlling the energy level of at least a first thermal point prior to it being activated to make a first print line and which is selected from a plurality of thermal points arranged in an array on a print head of a thermal printer that has made at least second and third print lines, said processor comprising:

a. memory means for storing first and second data representative of the print states of second and third thermal points, respectively, selected from said plurality of thermal points and positioned adjacent said first thermal point during said second print line, third data representative of the print state of said first thermal point during said second print line, and fourth data representative of the print state of said first thermal point during said third print line;

b. a calculation circuit for determining said energy level of said first thermal point during said first print line; and c. communication means for interconnecting said memory means to said calculation circuit, and sending said first, second, third, and fourth data from said memory means to said calculation circuit.

2. The processor of claim 1, further comprising means for controlling the speed of said print head.

3. The processor of claim 2, wherein said means for controlling the speed of said print head comprises:

a. means for placing said first, second, third, and fourth data into one predefined category selected from a plurality of predefined categories; and b. means for selectively modifying said speed of said print head based upon which one of said plurality of predefined categories said first, second, third, and fourth data have been placed.

4. A method for controlling the energy level of at least a first thermal point prior to it being activated to make a first print line and which is selected from a plurality of thermal points arranged in an array on a print head of a thermal printer that has made at least second and third print lines, said method comprising the steps of:

a. storing first and second data representative of the print states of second and third thermal points, respectively, selected from said plurality of thermal points and positioned adjacent said first thermal point during said second print line, third data representative of said first thermal point during said second print line, and fourth data representative of said first thermal point during said third print line;

b. sending said first, second, third, and fourth data to a calculation circuit, whereby the quantity of said energy level is calculated; and c. sending a signal representative of said energy level to said first thermal point.

5. The processor of claim 4, further comprising means for controlling the speed of said print head.

6. The processor of claim 5, wherein said means for controlling the speed of said print head comprises:

1. means for placing said first, second, third, and fourth data into one predefined category selected from a plurality of predefined categories; and 2. means for selectively modifying said speed of said print head based upon which one of said plurality of predefined categories said first, second, third, and fourth data have been placed.

7. A thermal printer having a print head that includes a plurality of thermal points arranged in an array, each of said thermal points adapted for independent energization for creating a first print line after having created a second print line and a third print line, said printer comprising:

a. means for selectively operating said printer in a single mode selected from a group comprising a single color mode and a multi-color mode;

b. means for controlling the energy applied to a first thermal point selected from said plurality of thermal points when said printer is in its said single color mode; and c. means for controlling the energy applied to said first thermal point when said printer is in its said multi-color mode.

8. The thermal printer of claim 7, wherein said means for controlling the energy applied to said first thermal point when said printer is in its said single color mode comprises a processor for controlling the energy applied to said first thermal point prior to it being activated to make a first print line after said printer has made at least second and third print lines, said processor comprising:

a. memory means for storing first and second data representative of the print states of second and third thermal points, respectively, selected from said plurality of thermal points and positioned adjacent said first thermal point during said second print line, third data respective of the print state of said first thermal point during said second print line, and fourth data representative of the print state of said first thermal point during said third print line;

b. a calculation circuit for determining said energy level of said first thermal point during said first print line; and c. communication means for interconnecting said memory means to said calculation circuit, and sending said first, second, third and fourth data from said memory means to said calculation circuit.

9. The thermal printer of claim 8, further comprising means for disabling said first and second data representative of said print states of said second and third thermal points.

10. The thermal printer of claim 9, wherein said means for controlling the energy applied to said first thermal point when said printer is in its said multi-color mode comprises a processor for controlling the energy applied to said first thermal point prior to it being activated to make a first print line after said printer has made at least second and third print lines, said processor comprising:

a. memory means for storing first data representative the print state of said first thermal point during said second print line;

b. a calculation circuit for determining said energy level of said first thermal point during said first print line; and c. communication means for interconnecting said memory means to said calculation circuit, and sending said first data from said memory means to said calculation circuit.

* * * * *